US008662739B2

(12) United States Patent
Kaufmann et al.

(10) Patent No.: US 8,662,739 B2
(45) Date of Patent: Mar. 4, 2014

(54) SHAKING APPARATUS FOR SAMPLE CONTAINERS

(75) Inventors: Klaus Kaufmann, München (DE); Helmut Herz, München (DE)

(73) Assignee: Thermo Electron LED GmbH, Langenselbold (DE)

( * ) Notice: Subject to any disclaimer, the term of this patent is extended or adjusted under 35 U.S.C. 154(b) by 1289 days.

(21) Appl. No.: 11/587,993

(22) PCT Filed: May 2, 2005

(86) PCT No.: PCT/EP2005/004737

§ 371 (c)(1),
(2), (4) Date: Jan. 23, 2008

(87) PCT Pub. No.: WO2005/107931

PCT Pub. Date: Nov. 17, 2005

(65) Prior Publication Data

US 2008/0159062 A1 Jul. 3, 2008

(30) Foreign Application Priority Data

May 3, 2004 (DE) ..... 10 2004 021 665

(51) Int. Cl.
*B01F 11/00* (2006.01)

(52) U.S. Cl.
USPC ..... 366/215; 366/111

(58) Field of Classification Search
USPC ..... 366/110, 208, 215, 216, 200, 108, 157, 366/154, 260, 255, 256, 111; 464/86, 81
See application file for complete search history.

(56) References Cited

U.S. PATENT DOCUMENTS

| | | | | | |
|---|---|---|---|---|---|
| 3,081,991 | A | * | 3/1963 | Swainson | 267/154 |
| 3,124,342 | A | * | 3/1964 | Ormond | 464/86 |
| 3,272,492 | A | * | 9/1966 | Jones | 464/84 |
| 3,539,156 | A | | 11/1970 | Zipperer et al. | |
| 3,799,557 | A | * | 3/1974 | Clark | 369/210 |
| 4,591,136 | A | * | 5/1986 | Leonard | 267/154 |
| 4,702,610 | A | * | 10/1987 | Reynolds, Jr. | 366/213 |
| 6,167,941 | B1 | | 1/2001 | Schallenberg | |

FOREIGN PATENT DOCUMENTS

| | | | |
|---|---|---|---|
| DE | 11 12 606 | B | 8/1961 |
| DE | 44 42 262 | A1 | 5/1996 |
| DE | 200 18 633 | U1 | 1/2001 |

(Continued)

OTHER PUBLICATIONS

International Search Report, dated Jul. 22, 2005, for corresponding International Application No. PCT/EP2005/004737.

(Continued)

*Primary Examiner* — Tony G Soohoo
*Assistant Examiner* — Anshu Bhatia
(74) *Attorney, Agent, or Firm* — Wood, Herron & Evans, LLP

(57) ABSTRACT

The invention relates to a method for shaking sample containers, especially micro titer plates, and to a shaking apparatus, comprising an oscillating plate holding the sample containers and an exciter drive for generating the oscillating movement of the oscillating plate. The oscillating plate is made to oscillate in resonance oscillation, with the oscillating plate being connected in a flexurally rigid manner with an apparatus base preferably by at least four spring elements which consist of several individual springs and is held in an oscillating plane.

13 Claims, 2 Drawing Sheets

(56) References Cited

FOREIGN PATENT DOCUMENTS

| | | | |
|---|---|---|---|
| GB | 1057877 | B1 | 2/1967 |
| JP | 10307070 | A | 11/1998 |
| JP | 11239848 | A | 9/1999 |
| JP | 2002302230 | A | 10/2002 |

OTHER PUBLICATIONS

International Preliminary Report, dated Nov. 16, 2006, for corresponding International Application No. PCT/EP2005/004737.

United Kingdom Intellectual Property Office, Patents Act 1977 Examination Report Under Section 18(3), Application No. GB0622186.5, dated Apr. 27, 2007 (3 pages).

State Intellectual Property Office of People's Republic of China, Second Office Action, Chinese Patent Application No. 200580017062.2 (PCT/EP2005/004737), dated Dec. 6, 2011 (8 pages).

Japanese Patent Office, English Translation of Decision of Rejection, Patent Application No. 2007-511990, Mailed Feb. 7, 2012 (2 pages).

ESPACENET, English Translation of Patent Abstracts of Japan, Publication No. 10-307070, Publication Date Nov. 17, 1998 (1 page).

ESPACENET, English Translation of JP11239848, http://worldwide.espacenet.com/publicationDetails/biblio?DB=worldwide.espacenet.com&II=0&ND=3&adjacent=true&locale=en_EP&FT=D&date=19990907&CC=JP&NR=11239848A&KC=A, retrieved on Mar. 12, 2012 (5 pages).

ESPACENET, English Translation of Patent Abstracts of Japan, Publication No. 2002-302230, Publication Date Oct. 18, 2002 (1 page).

European Patent Office, German Patent No. DE 200 18 633 U1, EPO Machine Translation, http://translationportal.epo.org/emtp/translate/?ACTION=description-retrieval&COUNTR, Jan. 30, 2012 (4 pages).

* cited by examiner

SHAKING APPARATUS FOR SAMPLE CONTAINERS

CROSS-REFERENCE TO RELATED APPLICATIONS

This is a national stage of International Application No. PCT/EP2005/004737, filed on May 2, 2005, which claims priority of German Patent Application No. 10 2004 021 665.7, filed May 3, 2004, the disclosure of each application is hereby incorporated by reference in their entirety.

FIELD OF THE INVENTION

The invention relates to a shaking apparatus for sample containers, and a method for shaking sample containers.

BACKGROUND OF THE INVENTION

Such shaking apparatus are used among other things for mixing chemical, biological or pharmaceutical samples in laboratories. For this purpose, the mixture components are filled into sample containers such as micro titer plates and arranged on an oscillating plate of the shaking apparatus. It is made to vibrate in order to thoroughly mix the mixture components, so that the mixture components of the sample are able to mix in the desired manner.

In modern laboratories it is currently common practice to use standardized micro titer plates as sample containers which comprise in a single plate a plurality of sample containers. By using such micro titer plates, a whole number of different samples or so-called libraries can be shaken simultaneously in a single shaking process. This improves on the one hand the working efficiency of the laboratories and increases on the other hand in a desirable manner the number of samples which can be examined in parallel or simultaneously. That is why shaking apparatuses for micro titer plates are used in modern laboratories especially for so-called high-throughput screening (HTS) methods in which the samples can be processed in an automated manner by robots for example.

A shaking apparatus which is outstandingly suitable for conventional micro titer plates is the shaking device with magnetic drive and automatic oscillating plate centering as disclosed in DE 20018633. With this device, it is possible in a very short time to shake the samples in the sample containers thoroughly and favorably by circular oscillating movements of the oscillating plate, thereafter to stop the same rapidly and to center the same in a defined basic position suitable for the robots.

In order to further increase the throughput and the size of the libraries to be analyzed simultaneously, the need for shaking apparatuses for micro titer plates with sample containers which are further reduced in size as compared with previously used sizes has increased strongly in recent times.

The invention is therefore based on the object of providing a shaking apparatus for sample containers and a method for shaking sample containers of the kind mentioned above in which the smallest possible sample containers or micro titer plates with a large number of the smallest possible containers can be used.

This object is achieved with the shaking apparatus for sample containers and with the method in such a way that the oscillating plate is made to vibrate in resonance oscillation. Further preferred embodiments of the invention are disclosed in the sub-claims.

SUMMARY OF THE INVENTION

The invention relates to a principally known shaking apparatus for sample containers, especially micro titer plates, comprising an oscillating plate holding the sample containers and an exciter drive for generating the oscillating movements of the oscillating plate. Electric drives are usually used in shaking apparatuses to make the oscillating plate oscillate. Other forms of drive can principally also be used. The known drives comprise unbalance exciters, piezoelectric exciters of oscillations, hydraulic drives or magnetic drives. Individual or several drives are arranged on the apparatus base and are usually connected via a suitable coupling means with the oscillating plate in such a way that they can make the same oscillate. In order to achieve a secure and position-stable bearing of the micro titer plates during the shaking process, holding apparatuses such as movable positioning elements or recesses or indentations are generally provided on the oscillating plates on the oscillating plates of the shaking apparatuses which hold the micro titer plate on the oscillating plate during the shaking process.

The invention comes with the advantage that as a result of the resonance oscillations of the oscillating plate it is possible to achieve very large forces of acceleration reaching up to 40 times gravitational acceleration which act upon the sample material situated in the sample containers. These high acceleration forces generate very high rotational speeds in the sample material within the shortest possible time, so that swirls are formed very quickly therein which produce an outstanding thorough mixing of the sample material. This favorable efficiency of the thorough mixing allows using very small sample containers. Since the formation of swirls within the sample containers depends on the rotational speed and the size of the sample containers, very small vessel sizes and small diameters demand higher rotational speeds than large sample containers.

By exciting the oscillating plate into resonance oscillations it is possible to thoroughly mix micro titer plates with 1536 or more sample containers (which are also known as wells) in an outstanding manner within seconds. Sample containers with angular base surface are principally more advantageous than round sample containers because the sample liquid collects more strongly in the corner areas. It is therefore made to rotate more easily and swirls can form more quickly.

The oscillating plate and at least one spring element connected with the same form a resonance oscillating system in a preferred embodiment of the shaking apparatus. The spring stiffness of the spring element substantially influences the spring stiffness of the system and thus predetermines a range for the resonance frequency of the system. The resonance frequency of the system thus occurring depends on the usual oscillation parameters of oscillating systems such as the moved mass, the frequency, the amplitude and other parameters influencing the resonance oscillation. Moreover, the oscillating plate is only carried and supported by the spring element. The deflection of the spring element at its free end further determines the throw of the oscillating plate in all directions. The invention thus comes with the advantage that only few components are required.

The shaking apparatuses used in automated laboratories must be stopped in such a way that the sample containers reliably reach a position which allows a defined access by a robot, e.g., feeding or removing by means of robot grippers. In an advantageous further development, the spring element for setting a basic position of the oscillating plate in the idle state assumes a defined position. The spring element arranged for providing the resonance oscillation system can also be used for adjusting the oscillating plate in the idle state. In this case, all additional components which may principally be destroyed by oscillations such as restoring pins and which are required for aligning the oscillating plate into a predetermined basic position can be omitted. Moreover, by arranging a self-restoring spring element, it is possible to omit a complex regulating mechanism on the drive which is otherwise used according to the state of the art because the oscillating plate is adjusted by the spring element oscillating automatically back to its initial position.

For the comparability of the different products of synthesis in the sample containers, it is mandatory that sample containers which are fastened above the surface of the oscillating plate by means of suitable fixing mechanisms and the samples contained therein perform identical shaking movements in a horizontal plane. That is why the support of the oscillating plate, which is also known as support table for the sample containers, is highly relevant with respect to the apparatus base. It must ensure that the oscillating plate only performs translatory movements.

The oscillating plate is preferably connected by means of at least four elements in an oscillating-proof manner to an apparatus base and is held in one oscillating plane. The four spring elements which in a rectangular oscillating plate are preferably arranged in their four outermost corners assume the coupling of the oscillating plate to an apparatus base which is usually made as heavy as possible. The forces generated during the oscillation of the oscillating plane are introduced via the spring elements into the apparatus base and absorbed by the same. At the same time, the bearing of the oscillating plate occurs via the four spring elements in such a way that the same is only able to move in a thus defined oscillating plane, i.e., in two predetermined dimensions. In the case of a usually horizontal arrangement of the oscillating plate only the movements situated in the horizontal are enabled.

Each spring element comprises in accordance with the invention at least one single spring. It can concern all current forms of springs. Spring steel brackets can also be used. All conventional forms of springs can principally be used, e.g., torsion rod springs or spiral springs, made of all suitable materials such as spring steel or permanently elastic plastic.

In a further development, each spring element comprises a spring assembly consisting of several individual springs, with the individual springs preferably concerning torsion rod springs. Individual torsion rod springs must be relatively massive as a result of the high loads by the resonance oscillations. This again requires a larger length of the individual springs or torsion rod springs for oscillation reasons, which leads to an undesirable increase in the overall size of the shaking apparatus. By bundling several relatively thin individual springs or torsion rod springs, it is possible to use overall shorter springs, which allows reducing the overall size of the apparatus and simultaneously achieving a favorable fatigue endurance limit of the spring elements. Moreover, the parallel arrangement of the torsion rod springs within the spring assembly without any additional auxiliary means ensures that the oscillating plate will only move in the oscillating plane.

Preferably, each spring element comprises on its side facing the oscillating plate a base on the plate side and on its side facing the apparatus base a base on the side of the apparatus base, between which at least one single spring each is held. These bases assume two functions in this respect. On the one hand, they are used for effective introduction of force from the base or oscillating plate into the spring. On the other hand, they assume a bundling function in the case of the arrangement of several individual springs, i.e., the formation of spring assemblies. The individual springs which are held at their ends in the bases cannot displace relative to the other spring ends and even and homogeneous oscillating properties are obtained in the spring assemblies. In other words, an even deformation of the overall assembly like a single spring is enabled. Moreover, the handling of the spring elements in their entirety is improved, which has major benefits in the production and maintenance of the shaking apparatus.

It is also advantageous when both the base on the plate side is connected with the oscillating plate and the base on the apparatus base side is each connected with the apparatus base in a flexurally rigid manner. This leads to an especially stable oscillating behavior of the oscillating plate relative to the apparatus base in combination with the bases which are also provided with a flexurally rigid configuration.

It is further preferable that the bases of the spring elements on the base side are connected in an integral manner with the oscillating plate. Integral shall be understood as a construction consisting of one element of base on the plate side and oscillating plate which is produced in a single production step like in a casting process. This leads to an especially stiff connection of the two parts which can be produced favorably and quickly.

In a further development, both the base on the plate side as well as the base on the side of the apparatus base each comprise at least one recess with a widened edge for fixing in a flexurally rigid manner at least one individual spring. The recess is used for clamping the individual spring in the base. The individual springs can be additionally pressed, glued or welded in the recesses. The widened edge of the recess ensures a favorable deformability of the spring loaded rods in the area of the clamping. This does not lead to a change in the effective spring lengths and the spring properties of the individual springs.

It is further advantageous when for limiting the throw at least one stop is arranged at a defined distance relative to a base on the plate side of at least one spring element. A maximum lateral deflection (i.e., the throw) of the oscillating plate is limited not on the plate itself but on a spring element. This comes with the advantage as compared with the state of the art that additional components which may be susceptible to malfunctions can be omitted between the apparatus base and the oscillating plate for limiting the throw because the bases of the spring elements are stable enough in order to easily assume this additional task.

It is advantageous with respect to a further development when the stop is a recess in the apparatus base which encloses the base on the plate side. Parts of the apparatus base which are present anyway can be used for limiting the throw. This reduces the number of the parts installed in the apparatus. This recess in the apparatus base is appropriately arranged in a circular way in order to create a limitation of the throw which has the same maximum in each direction. The base on the plate side should also have an external circular-cylindrical shape in the region of the recess. The same maximum throw in each direction of oscillation is thus obtained in the case of centric arrangement of the spring element base in the recess through the difference of the two diameters.

It is also advantageous when for damping the noise a damping element is arranged between the stop and the base on the plate side which is used for limiting the throw. This reduces the impact noises occurring by the impact of the base on the stop and also reduces the mechanical influences on the base by the impacts. As a result, both the operating noise is reduced and durability and strength of the base is improved.

An embodiment of the shaking apparatus is especially preferable which comprises feedback control apparatus which is connected with the exciter drive for controlling the oscillating behavior of the oscillating plate. Said feedback control apparatus monitors the oscillating behavior of the apparatus and automatically regulates the drive in such a way that the resonance oscillations are generated at first and are maintained evenly for a predetermined period of time. The feedback control apparatus determines the oscillating behavior of the oscillating plate depending on the loading of the sample containers by suitable measurement of the deflection for example and those controls the drive in such a way that the desired oscillations are obtained. This leads to an overall very stable oscillating behavior of the oscillating plate and also saves energy because the feedback control system hardly demands drive output from the drive during the resonance oscillation. Moreover, an automatic starting unit which is implemented in the feedback control apparatus can be used to prevent splashing of the sample material at the beginning of the oscillation movement by smooth starting of the motion of the oscillating plate.

It is especially advantageous when the exciter drive is a magnetic drive and a current measurement is performed for controlling the oscillating behavior. In the case of this type of drive, which can be controlled in a very advantageous and fine manner, four electromagnets for example are arranged in a crosswise manner and drive an armature movably held in the middle of the cross. Both the amplitude and the frequency can be changed in a simple manner during operation by setting the magnetic strength. The determination of the actual oscillating behavior of the oscillating plate occurs by measuring the drive current. The arrangement of additional measuring means on the shaking apparatus which are often sensitive to oscillations can thus especially be omitted.

A damping apparatus is arranged on the base of the apparatus in a further development, which damping apparatus is used for noise reduction for example. Said damping apparatus can be a foam mat or the like.

The object of the invention is achieved in accordance with the method of the invention in such a way that the oscillating plate is made to oscillate in resonance oscillation for oscillating sample containers arranged on an oscillating plate and is held for a predetermined period of time in resonance oscillation. The sample containers are accelerated very strongly by generating resonance oscillations. This leads to especially strong turbulences in the samples, with this effect being used to provide the sample containers with a smaller configuration while retaining the same thorough mixing quality and mixing time.

Preferably, the oscillating plate is held for this purpose in a horizontal oscillating plane. This is appropriate especially in cases of sample containers that are not sealed. It can also be advantageous however in the thorough mixing of certain sample materials and further leads to a resonance oscillation which is easier to control because it occurs in only one plane.

Preferably, the resonance oscillation of the oscillating plate is set in such a way that the oscillating frequency of the oscillating plate is varied at constant amplitude until reaching the resonance frequency and thereafter the amplitude is set to a predetermined amplitude value depending on the filling of the sample containers to be mixed. The sample mass can be determined prior to the start of the mixing by means of a weight measurement for example and already predetermined oscillating parameters can be set on the exciter drive depending on this.

Moreover, the resonance oscillation is preferably determined with a current measurement on the exciter drive. The resonance oscillation can then be detected electronically in a very rapid and precise manner, e.g., by measuring a current minimum when reaching the same.

The oscillating behavior of the oscillating plate is advantageously controlled by a feedback control apparatus which automatically adjusts the resonance frequency and the oscillating amplitude to the loading of the oscillating plate. This reduces the work to be made manually for setting and leads to a substantially quicker and more uniform generation of oscillations.

It is especially appropriate when at least one spring element connected with the oscillating plate forms a resonance oscillation system, with the spring element always assuming a defined position for setting a basic position of the oscillating plate in the idle state. A principal oscillating behavior of the oscillation system can be predetermined already by way of the spring stiffness of the spring element and can optionally be changed in a rapid and simple way by exchanging the same against a spring element with another stiffness. This can be appropriate for example when shaking with a large bandwidth of the sample quantities to be shaken. The spring element also leads to an automatic return of the oscillating plate to a basic position which is necessary for the automatic loading of the sample containers. The spring element which is actually used for achieving certain oscillation properties leads to the consequence that it is possible to omit additional components for setting the basic setting.

BRIEF DESCRIPTION OF THE DRAWINGS

The invention is explained below by reference to an embodiment shown in the schematic drawings, wherein.

DETAILED DESCRIPTION OF THE INVENTION

Figure 1:
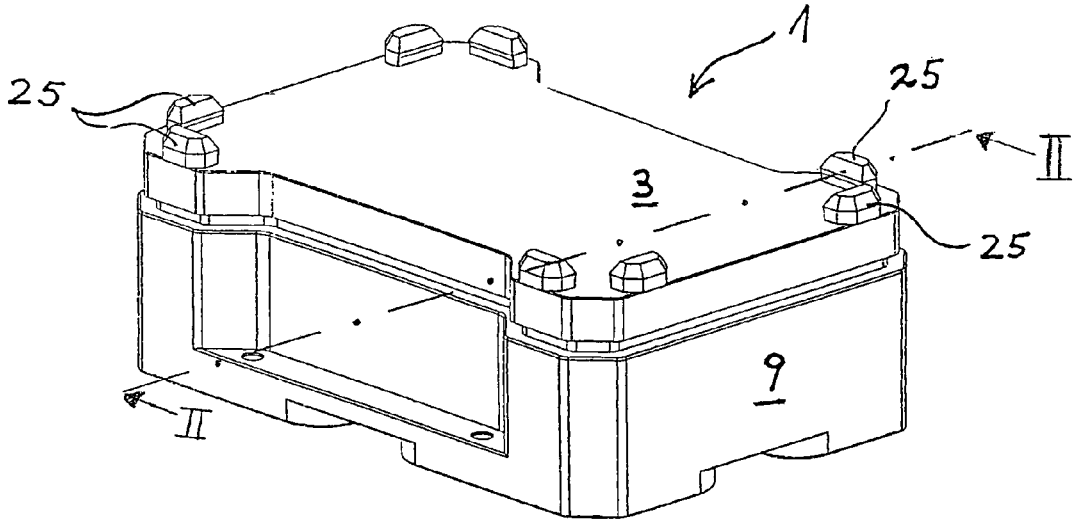
FIG. 1 shows a spatial view of a shaking apparatus for sample containers.

FIG. 1 shows a three-dimensional view of a first embodiment of a shaking apparatus 1. The apparatus 1 comprises an oscillating plate 3 arranged above the apparatus base 9. Eight positioning elements 25 are provided on the oscillating plate 3 for holding a rectangular micro titer plate (not shown), of which two each are arranged in a rectangular fashion with respect to each other in order to hold the micro titer plate at its four corners.

Figure 2:
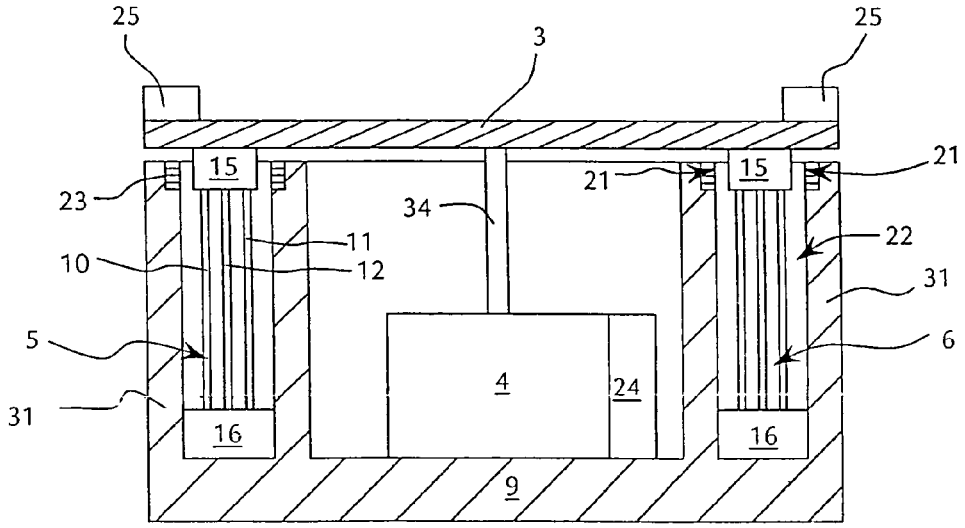
FIG. 2 shows a cross-sectional view through the shaking apparatus along a line of intersection II-II.
Figure 3:
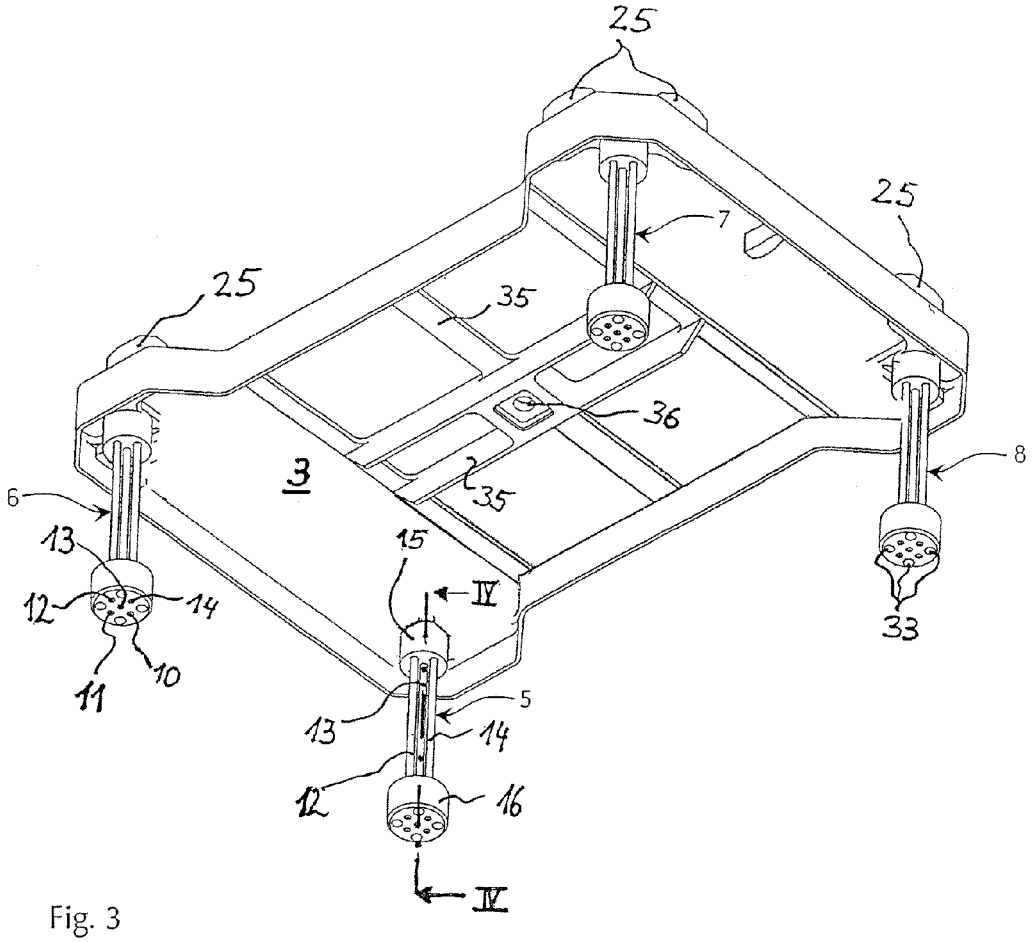
FIG. 3 shows a spatial view under an oscillating plate equipped with four spring elements.

As is shown in FIGS. 2 and 3, four spring elements 5, 6, 7, 8 are attached in a vibration-stable manner beneath the oscillating plate 3 in such a way that they form a resonance oscillation system together with oscillating plate 3. In this mass-and-spring system, the oscillating plate is elastically linked via the spring elements 5, 6, 7, 8 to the comparatively heavy housing base 9. In order to prevent any slippage of the shaking apparatus 1 on the base, anti-slip rubber feet are arranged beneath the apparatus base 9. Solutions are also possible in which the apparatus plate is fastened to the base by means of screws or glue for example.

The four spring elements hold the oscillating plate 3 in a horizontal oscillating plane, so that the oscillating plane 3 can only move within the plane. This effect is the result that the spring elements 5, 6, 7 and 8 each comprise a spring assembly made up of five torsion rod springs 10, 11, 12, 13 and 14 which are arranged parallel with respect to each other, consist of spring steel and do not deform noticeably in their longitudinal direction. The cylindrically round torsion rod springs have the same spring constants, spring stiffness and in all low damping properties in their directions of oscillations.

As is shown in FIG. 3, the four spring elements 5, 6, 7, 8 are each connected with the oscillating plate 3 via bases 15 on the plate side. At their respective other ends, the four spring elements 5, 6, 7, 8 each comprise bases 16 on the base side, with which the spring elements 5, 6, 7, 8 are fastened to the apparatus base 9. The bases 15 and 16 as shown herein concern flexurally rigid, massively arranged metal bodies in which the individual torsion rod springs 10, 11, 12, 13 and 14 are held in a flexurally rigid manner.

Both the bases 15 on the plate side as well as the bases 16 on the base side are each provided with a circular-cylindrical configuration, with the bases 15 on the plate side having a smaller outside diameter than the bases 14 on the base side. The spring elements 5, 6, 7, 8 are also inserted into circular-cylindrical recesses 22 which are formed in the housing wall 31 of the apparatus base 9.

For fastening the spring elements 5, 6, 7, 8 in a flexurally rigid manner to the apparatus base 9, the recesses 22 have precisely the width of the base 16 on the base side, so that the same is unable to twist relative to the apparatus base 9. The bases 16 on the base side each comprise four bolt holes 33 on their bottom sides. The bases 16 on the base side are screwed together by means of the same to the apparatus base 9 by means of four screws each (not shown).

The bases 15 on the plate side which are provided with a narrower configuration and are integrally connected with the oscillating plate 3 ensure that the oscillating plate 3 can be moved in a reciprocating fashion in the horizontal direction by means of a coupling rod 34 by an exciter drive 4. The maximum throw of the oscillating plate 3 is obtained from the distance between the diameter through the recesses 22 and the bases 15 on the base side. As a result, the spring elements 5, 6, 7, 8 are used for limiting the throw of the oscillating plate 3. For damping the impact of the base 15 on the plate side against the stops 21, annular damping elements 23 made of rubber for example are incorporated in the stops 21. It is also possible to fasten the damping elements 23 to the bases 15.

Figure 4:
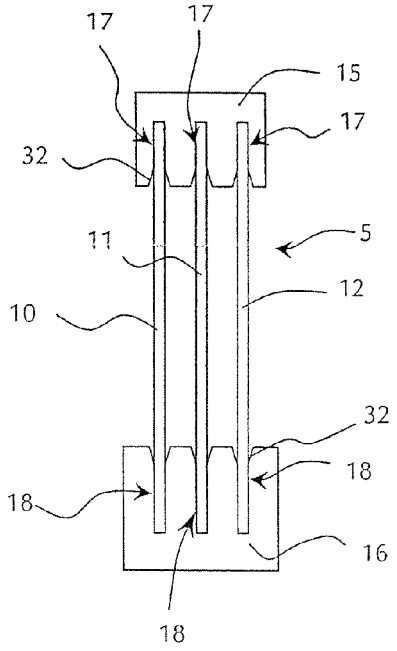
FIG. 4 shows a sectional view through a spring element.

The bases 15 and 16 of the spring elements 5, 6, 7, 8 connect on the one hand the individual torsion rod springs 10, 11, 12, 13, 14 with each other in such a way that they deform like a single spring jointly. On the other hand, the bases 15, 16 are used for effective transmission of the oscillation forces such as the centrifugal forces from the oscillating plate 3 into the spring elements 5, 6, 7, 8 and from the spring elements 5, 6, 7, 8 into the apparatus base 9. As is shown in FIG. 3, the torsion rod springs 10, 11, 12, 13 and 14 are inserted over the entire height of at least the bases 16 on the base side into recesses 18 through the bases 15 and 16 and tightly pressed together with the bases 15, 16 in the recesses 17, 18. In the embodiment of a spring element 5 as shown in FIG. 4, the recesses 17, 18 do not completely penetrate the bases 15, 16 but are shaped in the manner of a bushing. The outer edges of the recesses 17 and 18 each comprise conically widened edges 32 which are used in the transitional region between the torsion rod spring and the respective socket 16 to permit a defined deflection in resonance operation.

On the opposite side, the base 13 on the plate side is integrally connected with the oscillating plate 3. The embodiment of the oscillating plate as shown in FIGS. 1 and 3 concerns a die cast part, so that the bases 15 on the plate side are produced in one piece together with the reinforcing elements 35 and a coupling receiver 36 for a coupling part 34.

As a result of the flexurally rigid configuration and fastening of the bases 15, 16, an especially favorable power transmission is obtained between the torsion rod springs 10, 11, 12, 13, 14 and the bases 15, 16, so that an S-shaped deformation figure forms in the individual springs during the oscillation, with the end pieces of the torsion rod springs 10, 11, 12, 13, 14 opening into the bases in an orthogonal manner relative to the oscillating plane. In other words, torques from the spring can be transmitted into the respectively adjacent component via the bases 13, 14 of the spring elements 5, 6, 7, 8. This leads to an especially stable oscillating behavior of the oscillating plate 3 in the oscillating plane.

As is further shown in FIG. 2, a feedback control apparatus 24 is situated on the exciter drive 4, which control apparatus controls the exciter drive 4 in such a way that the oscillating plate 3 is placed into resonance oscillation and held there. The feedback control apparatus 24 measures the current of the drive 4 which has a characteristic value at resonance. It determines therefrom the oscillating behavior of oscillating plate 3.

A damping apparatus in the form of a damping mat made of foam is arranged beneath the apparatus base 9. It is used for noise reduction. In the case of suitable arrangement, the damping apparatus can also be used as an oscillation-damping anti-slip base for the shaking apparatus 1.

The actual shaking of the micro titer plates arranged on the oscillating plate 3 occurs in such a way that the oscillating plate is made to move in a circular or ellipsoid manner via the coupling part 34 in connection with the oscillating plate 3 through superimposing sine and cosine oscillations. The spring elements 5, 6, 7, 8 latch the oscillating plate 3 to the horizontal oscillating plane and each yield in the direction of the plane. Upon reaching the resonance oscillation with 40 times gravitational acceleration in the oscillating plate 3, load values of 1 kg per spring assembly 5, 6, 7, 8 are generated by the oscillating plate which has a weight of approximately 60 g.

For reaching the resonance oscillation in the oscillating plate 3, the drive 4 is controlled by a feedback control apparatus 24 in such a way that at a low amplitude at first, which amplitude can also be designated as throw or deflection of the oscillating plate 3, the frequency is slowly increased, i.e., the number of reciprocating movements per unit of time, until the feedback control apparatus 24 determines by measurement of current on the drive 4 that the oscillating plate 3 oscillates in resonance. The frequency is determined in other words by wobbling. The determination of the resonance oscillation occurs by exploiting the effect that the impedance of the exciter drive changes, with the current decreasing in the exciter drive 4 upon reaching the resonance oscillation when the oscillating plate 3 oscillates in resonance. This change in current is determined by the feedback control apparatus 24 by suitable measuring means and processed in such a way that it controls the drive output of the exciter drive 4 in such a way that the oscillating plate 3 is still held in resonance oscillation for the fixed duration of a few seconds for example. Then the amplitude of the oscillation is increased to a previously determined value.

This amplitude value is chosen by taking into account the filling of the micro titer plate. A lower amplitude can be chosen at higher load, and a higher amplitude at lower load. The sample material should principally not splash out of the sample containers, so that this represents the upper limit of the amplitude. On the other hand, an effective mixing of the sample materials should be achieved in the sample containers within the shortest possible mixing time, so that this leads to the bottom limit of the amplitude. When changing the amplitude there may be changes in the frequency, so that the feedback control apparatus iteratively adjusts the amplitude and frequency of the oscillation to the predetermined values.

When shaking in the resonance frequency, turbulences are quickly obtained especially in angular sample vessels or wells, by means of which the sample liquid is displaced as a wave. The solids or particles which oscillate with more difficulty or slower will then mix well with the liquid.

What is claimed is:

1. A shaking apparatus for sample containers, comprising a base, an oscillating plate arranged for holding the sample containers and an exciter drive for generating oscillating movements of the oscillating plate, wherein the oscillating plate is operatively connected with the base resiliently in an oscillation-damping manner by at least four spring elements and is held in an oscillation plane, wherein the oscillating plate and the at least four spring elements form a resonance oscillation system operable to be oscillated by the exciter drive, and further wherein each of the at least four spring elements comprises at least one spring assembly comprising a plurality of individual springs, with each individual spring comprising a torsion rod spring and being spaced by a gap from each of the other plurality of individual springs in the at least one spring assembly.

2. A shaking apparatus according to claim 1, wherein the oscillating plate and the at least four spring elements which are connected with the same form a resonance oscillation system.

3. A shaking apparatus according to claim 2, wherein the at least four spring elements assume a defined position in the idle state for setting a basic position of the oscillating plate.

4. A shaking apparatus according to claim 1, wherein each of the at least four spring elements comprises at its respective end facing the oscillating plate a base on the plate side and its respective end facing the apparatus base a base on the base side, between which the plurality of individual springs are held.

5. A shaking apparatus according to claim 1, wherein each base on the plate side is connected in a flexurally rigid manner with the oscillating plate and each base on the base side is connected with the apparatus base.

6. A shaking apparatus according to claim 4, wherein the bases on the plate side of the at least four spring elements are connected in an integral fashion with the oscillating plate.

7. A shaking apparatus according to claim 5, wherein each of the bases on the plate side and each of the bases on the base side comprises at least one recess with a widened edge for holding in a flexurally rigid manner at least one individual spring.

8. A shaking apparatus according to claim 4, wherein at least one stop is arranged at a defined distance from a base on the plate side of at least one spring element for the purpose of limiting the throw.

9. A shaking apparatus according to claim 8, wherein the stop is a recess in the apparatus base which encloses the base on the plate side.

10. An apparatus according to claim 8, wherein for damping the noise a damping element is arranged between the stop and the base on the plate side used for limiting the throw.

11. A shaking apparatus according to claim 1, wherein the shaking apparatus comprises a feedback control apparatus for controlling the oscillating behavior of the oscillating plate, which control apparatus is connected with the exciter drive.

12. A shaking apparatus according to claim 1, wherein the exciter drive is a magnetic drive and a current measurement is performed for controlling the oscillating behavior.

13. A shaking apparatus according to claim 1, wherein a damping apparatus is arranged on the apparatus base.

* * * * *

UNITED STATES PATENT AND TRADEMARK OFFICE

CERTIFICATE OF CORRECTION

PATENT NO. : 8,662,739 B2
APPLICATION NO. : 11/587993
DATED : March 4, 2014
INVENTOR(S) : Klaus Kaufmann It is certified that error appears in the above-identified patent and that said Letters Patent is hereby corrected as shown below:

In the Specification:

In column 2, lines 18-19, change "on the oscillating plates on the oscillating plates of the shaking apparatuses" to --on the oscillating plates of the shaking apparatuses--.

In column 5, line 9, change "for example and those controls the drive" to --for example and thus controls the drive--.

In the Claims:

In claim 4, column 9, line 31, change "a base on the plate side and its respective end facing the apparatus base" to --a base on the plate side and at its respective end facing the apparatus base--.

Signed and Sealed this
Sixteenth Day of September, 2014

Michelle K. Lee

Michelle K. Lee
*Deputy Director of the United States Patent and Trademark Office*